US011569005B2

(12) United States Patent
Moriyama et al.

(10) Patent No.: US 11,569,005 B2
(45) Date of Patent: Jan. 31, 2023

(54) CABLE

(71) Applicant: Hitachi Metals, Ltd., Tokyo (JP)

(72) Inventors: Masashi Moriyama, Tokyo (JP); Detian Huang, Tokyo (JP); Yoshinori Tsukamoto, Tokyo (JP); Masanori Kobayashi, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 17/460,581

(22) Filed: Aug. 30, 2021

(65) Prior Publication Data

US 2022/0076861 A1 Mar. 10, 2022

(30) Foreign Application Priority Data

Sep. 7, 2020 (JP) ..... JP2020-149556
Jul. 12, 2021 (JP) ..... JP2021-114981

(51) Int. Cl.

| | |
|---|---|
| ***H01B 7/08*** | (2006.01) |
| ***H01B 7/18*** | (2006.01) |
| ***H01B 11/08*** | (2006.01) |
| *H01B 7/04* | (2006.01) |

(52) U.S. Cl.
CPC ..... *H01B 7/1895* (2013.01); *H01B 11/08* (2013.01); *H01B 7/041* (2013.01)

(58) Field of Classification Search
CPC ... H01B 3/44; H01B 7/02; H01B 7/04; H01B 7/06; H01B 7/041; H01B 7/1895; H01B 11/02; H01B 11/04; H01B 11/06; H01B 11/08
USPC ..... 174/110 R, 113 R, 113 C, 115, 116
See application file for complete search history.

(56) References Cited

U.S. PATENT DOCUMENTS

| | | | | |
|---|---|---|---|---|
| 3,678,177 | A * | 7/1972 | Lawrenson | H01B 11/00 174/113 AS |
| 5,834,699 | A * | 11/1998 | Buck | H01B 7/041 174/113 R |
| 6,310,286 | B1 * | 10/2001 | Troxel | H01B 11/005 174/34 |
| 6,984,788 | B2 * | 1/2006 | Grogl | H01B 11/1033 174/106 R |
| 7,550,674 | B2 * | 6/2009 | Jean | H01B 11/04 174/113 C |
| 8,089,000 | B2 * | 1/2012 | Van Der Meer | H01B 7/288 174/113 C |

(Continued)

FOREIGN PATENT DOCUMENTS

JP 5457241 B2 4/2014

*Primary Examiner* — William H. Mayo, III
(74) *Attorney, Agent, or Firm* — McGinn I.P. Law Group, PLLC.

(57) ABSTRACT

A cable includes a cable core including a linear filler, and a plurality of core wires for signal transmission, a shield layer covering around the cable core, and a sheath covering around the shield layer. The filler includes a first filler provided at a cable center, and a plurality of second fillers provided around the first filler to form a cross-shape with the first filler in a cross-section perpendicular to a cable longitudinal direction. The cable core is configured in such a manner that the plurality of core wires and the plurality of second fillers are spirally twisted around the first filler to be alternately arranged in a circumferential direction.

10 Claims, 4 Drawing Sheets

(56) References Cited

U.S. PATENT DOCUMENTS

| | | | | |
|---|---|---|---|---|
| 10,418,153 | B2 * | 9/2019 | Blaich | H01B 3/44 |
| 2005/0045367 | A1 * | 3/2005 | Somers | H01B 11/04<br>174/113 C |

* cited by examiner

CABLE

CROSS-REFERENCE TO RELATED APPLICATION

The present application is based on Japanese patent application No. 2020-149556 filed on Sep. 7, 2020 and Japanese patent application No. 2021-114981 filed on Jul. 12, 2021, the entire contents of which are incorporated herein by reference.

BACKGROUND OF THE INVENTION

1. Field of the Invention

The present invention relates to a cable.

2. Description of the Related Art

As a communication cable for signal transmission, e.g., a Local Area Network (LAN) cable or a coaxial cable has been known. Especially, Japanese Patent No. 5457241 suggests a twisted pair cable comprising a cross-shaped filler including four walls radially extending from a center, a twisted pair wire arranged between the walls of the cross-shaped filler, a shield layer ordinary arranged at outer peripheries of the cross-shaped filler and the twisted pair wire, and a sheath, as the LAN cable.

Patent Document 1: Japanese Patent No. 5457241

SUMMARY OF THE INVENTION

In recent years, it is desired to arrange a signal transmission cable across a moving part or a swinging part for industrial robot and so on. For the signal transmission cable arranged across the moving part or the swinging part, it is necessary to have good transmission characteristics and high flex resistance to fulfill the standard values such as the category 6A.

However, when using the twisted pair cable comprising the above cross-shaped filler as the cable arranged to the moving part or the swinging part, the cable has a problem that fails to obtain enough flex resistance since the cross-shaped filler is hard to be bent, and is easily broken when the cable is repeatedly bent. In addition, when the cross-shaped filler is broken, crosstalk causes at the broken part and crosstalk between the twisted pair wire (pair-to-pair crosstalk) increases. Further, transmission characteristics may decrease since the position of the twisted pair wire is unstable.

Thus, it is an object of the invention to provide a cable that can improve flex resistance and obtain good transmission characteristics.

According to an embodiment of the invention, a cable comprises:

a cable core comprising a linear filler, and a plurality of core wires for signal transmission;

a shield layer covering around the cable core; and a sheath covering around the shield layer, wherein the filler comprises a first filler provided at a cable center, and a plurality of second fillers provided around the first filler to form a cross-shape with the first filler in a cross-section perpendicular to a cable longitudinal direction, wherein the cable core is configured in such a manner that the plurality of core wires and the plurality of second fillers are spirally twisted around the first filler to be alternately arranged in a circumferential direction.

Advantageous Effects of Invention

According to the present invention, it is possible to provide a cable that can improve flex resistance and obtain good transmission characteristics.

BRIEF DESCRIPTION OF THE DRAWINGS

Next, preferred embodiment according to the present invention will be described with reference to appended drawings, wherein.

DETAILED DESCRIPTION OF THE PREFERRED EMBODIMENT

Embodiment

The embodiment of the present invention will be explained in conjunction with appended drawings as follows.

Figure 1:
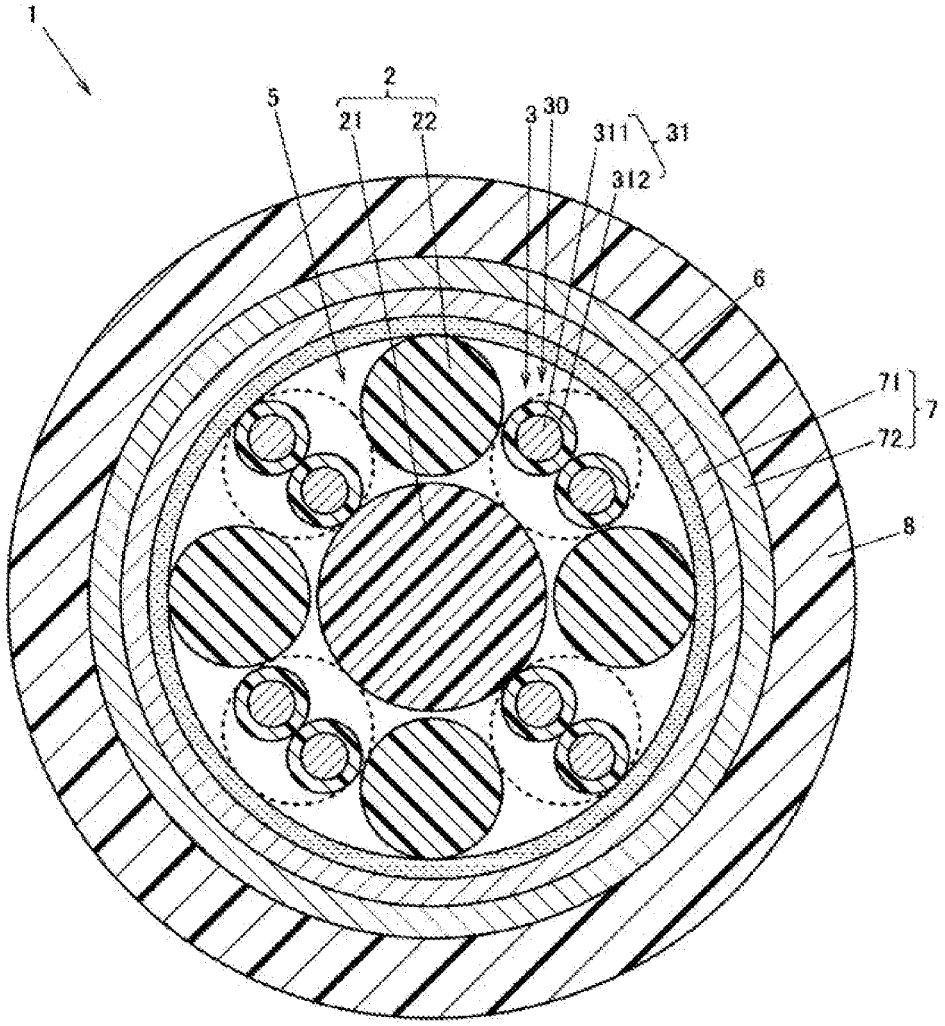
FIG. 1 is a cross-sectional view showing a cross-section perpendicular to a cable longitudinal direction of a cable according to an embodiment of the present invention.

FIG. 1 is a cross-sectional view showing a cross-section perpendicular to a cable longitudinal direction of a cable according to the embodiment. The cable 1 is a signal transmission cable (i.e., so-called LAN cable) arranged across a moving part or a swinging part for industrial robot and so on. In the present embodiment, the cable 1 is a Category 6 LAN cable.

As shown in FIG. 1, the cable 1 comprises a cable core 5 comprising linear fillers 2 and a plurality of core wires 3 for signal transmission, a binder tape 6 wound around the cable core 5, a shield layer 7 provided to cover around the binder tape 6, and a sheath 8 covering around the shield layer 7.

(Core Wire 3)

In the present embodiment, the core wire 3 comprises a twisted pair wire 30. The twisted pair wire 30 is used for transmitting differential signals. The twisted pair wire 30 is formed by twisting a pair of insulated wires 31. In the present embodiment, four twisted pair wires 30 are used. That is, eight insulated wires 31 in total are used. In the meantime, the number of twisted pair wires 30 (the core wire 3) used for the cable 1 is not limited thereto. In addition, the core wire 3 may be a double-core parallel cable in which a pair of the insulated wires 31 are arranged in parallel.

The insulated wire 31 constituting the twisted pair wire 30 comprises a conductor 311, and an insulator 312 covering around the conductor 311. It is preferable to use a stranded wire conductor produced by stranding a plurality of metal wires together as the conductor 311 in order to improve resistance for bending. In the present embodiment, as the conductor 311, a stranded wire conductor produced by stranding a plurality of metal wires made of tin-plated annealed copper (soft copper) wire and the like having an outer diameter of 0.08 mm is used.

It is preferable to reduce a thickness of the insulator 312 as much as possible to reduce a diameter of the cable 1. For example, it is preferable to set the thickness of the insulator 312 at approximately 0.10 to 0.30 mm. In the meantime, the outer diameter of the insulated wire is preferably, e.g., 0.6 to 1.0 mm. In the present embodiment, the insulator 312 composed of fluoropolymer which can be resin molded to have a thin wall is used. As the fluoropolymer used for the insulator 312, perfluoro ethylene propylene copolymer (FEP), perfluoro alkoxy alkane (PFA) can be used. In addition, as the insulator 312, fluoropolymers including polyethylene (PE) or polypropylene (PP) may be used. The insulator 312 comprising fluoropolymer including FEP or PFA decreases friction (i.e., increase slidability) when a surface of the insulator 312 contacts the other member (the fillers or the insulator 312 of the other insulated wire 31) when repeatedly bending the cable, as compared to the fluoropolymer including PE or PP. Hereby, the cable 1 can obtain high flex resistance.

In addition, the insulator 312 is preferably formed around the conductor 311 in a tubular shape by tube molding. Hereby, it is possible to move the conductor 311 in the insulator 312 along a longitudinal direction of the insulated wire 31. It suppresses the conductor 311 from being broken when the cable 1 is bent.

For each twisted pair wire, a twisting direction of the conductor 311 is opposite to a twisting direction of the twisted pair wire 30. For example, if the twisting direction of the conductor 311 is the same as the twisting direction of the twisted pair wire 30, the twisted pair wire 30 will be twisted in a tightening direction of the twisting of the conductor 311, and a load applied to the metal wires included in the conductor 311 increases. Thus, it may easily cause the disconnection e.g., when the cable 1 is bent. In this case, the twisting direction of the conductor 311 is a rotational direction of the metal wire from the other end to one end when being viewed from the one end of the insulated wire 31. Further, the twisting direction of the twisted pair wire 30 is a rotational direction of the insulated wire 31 from the other end to the one end when being viewed from the one end of the twisted pair wire 30.

The twist pitches of respective twisted pair wires 30 are preferably set to be different from each other so as to suppress crosstalk between the twisted pair wires 30 (hereinafter referred to as "pair-to-pair crosstalk"). It is preferable to set the twist pitches of respective twisted pair wires 30 at different twist pitches e.g., within a range from 10 to 20 mm. It is preferable to set a difference between the twist pitches of the respective twisted pair wires 30 at not less than 2 mm. The twist pitch of the twisted pair wire 30 is an interval between longitudinal positions (along a longitudinal direction of the twisted pair wire 30) of an arbitrary insulated wire 31 where the arbitrary insulated wire 31 is located at the same position in a circumferential direction of the twisted pair wire 30.

(Filler 2)

The filler 2 comprises one first filler 21 and four second fillers 22. The first filler 21 and the second fillers 22 are arranged to form a cross-shape in a cross-sectional view perpendicular to the cable longitudinal direction.

The first filler 21 is provided at a center of the cable. The center of the cable is a part where the load is mostly concentrated when the cable 1 is bent. The load applied to each twisted pair wire 30 is controlled and the disconnection in the insulated wire 31 is suppressed when the cable 1 is repeatedly bent, by arranging the first filler 21 at the center of the cable, and thus, it is possible to improve the flex resistance.

The second filler 22 serves to suppress the pair-to-pair crosstalk by distancing (separating) the twisted pair wires 30, 30 (cable cores 3, 3) from each other in the circumferential direction. The second filler 22 is arranged between the twisted pair wires 30, 30 adjacent to each other in the longitudinal direction. That is, the twisted pair wires 30 and the second fillers 21 are alternately arranged in the longitudinal direction at an outer periphery of the first filler 21. An outer diameter of the first filler 21 is greater than an outer diameter of the second filler 22. For example, the outer diameter of the first filler 21 is preferably 1.5 to 1.7 times the outer diameter of the second filler 22. Hereby, it is possible to further improve the flex resistance in alternately arranging the twisted pair wires 30 and the second fillers 22 in the cable 1. In the present embodiment, the outer diameter of the first filler 21 is 1.66 times the outer diameter of the second filler 22. That is, the thickness of the first filler 21 is greater than the thickness of the second filler 22. A cross-sectional area of the cross-section perpendicular to the cable longitudinal direction of the first filler 21 is greater than cross-sectional area of the cross-section perpendicular to the cable longitudinal direction of the second filler 21.

The outer diameter of the second filler 22 is approximately the same as the outer diameter of the twisted pair wire 30 (core wire 3). More specifically, the outer diameter of the second filler 22 is preferably 0.8 to 1.0 times the outer diameter of the twisted pair wire 30 (core wire 3). By setting the outer diameter of the second filler 22 to be 0.8 times or more the outer diameter of the twisted pair wire 30, the twisted pair wires 30 adjacent to each other in the circumferential direction will be separated from each other enough for suppressing the pair-to-pair crosstalk, even though the cable 1 is repeatedly bent. It is preferable to set the outer diameter of second filler 22 to be 0.9 times or more the outer diameter of the twisted pair wire 30 in order to further suppress the pair-to-pair crosstalk. In addition, if the outer diameter of the second filler 22 is greater than the outer diameter of the twisted pair wire 30, a space around the twisted pair wire 30 will increase and the arrangement of the twisted pair wire 30 will be unstable. And thus, the transmission characteristics may decrease. Thus, it is preferable to set the outer diameter of the second filler 22 to be 1.0 times or more the outer diameter of the twisted pair wire 30. That is, the arrangement of the twisted pair wire 30 is stable and the distance between both the twisted pair wires 30 can be easily kept by setting the outer diameter of the second filler 22 at not more than 1.0 times the outer diameter of the twisted pair wire 30 even if repeatedly bending the cable 1. And thus, it is possible to control the deterioration in transmission characteristics due to a positional shift (misalignment) of the twisted pair wire 30. In this case, the outer diameter of the twisted pair wire 30 is 1.28 mm, and the outer diameter of the second filler 22 is 1.20 mm.

In the present embodiment, since four second fillers 22 are arranged around the first filler 21 at equal intervals, the first filler 21 and the second fillers 22 are integrated in such a manner that an approximately cross-shaped filler as a whole is arranged in the cross-section perpendicular to the cable longitudinal direction. Conventionally, a communication cable including a single filler having a cross-shape in a cross-section perpendicular to the cable longitudinal direction has been known. Such a communication cable is hard to be bent due to the cross-shaped filler. In addition, the cross-shaped filler which is hardly bent may be easily broken when being repeatedly bent. When the filler is broken, the crosstalk occurs at the broken position and the pair-to-pair crosstalk increases. In addition, the transmission characteristics decrease since the position of the twisted pair wire 30 is unstable.

Meanwhile, in the present embodiment, since the cross-shaped filler 2 is composed of the first filler 21 arranged at the center of the cable and the plurality of second fillers 22 which are provided around the first filler 21 separately from the first filler 21, a bending stress is dispersed by a relative movement between the first filler 21 and the second fillers 22 in the cable longitudinal direction when the cable 1 is bent. As a result, even though the cable 1 is repeatedly bent, the first and second fillers 21, 22 would not be easily broken. Therefore, it is possible to improve the flex resistance, and to keep good transmission characteristics by suppressing the positional shift of the twisted pair wire 30 and the increase of the pair-to-pair crosstalk.

In addition, in the present embodiment, the plurality of second fillers 22 are provided to be contactable/separable (attachable to and detachable from) when the cable core 5 is bent. According to this configuration, it is possible to suppress the second filler 22 from being broken when the cable 1 is bent, and to improve the flex resistance.

Each of the first filler 21 and the second filler 22 is preferably composed of a material having a surface which is slippery and hard to wear. In addition, each of the first filler 21 and the second filler 22 is preferably composed of a material having a permittivity as low as possible so as to suppress the deterioration in transmission characteristics. For example, an XF coating wire composed of a resin coated with polyethylene (PE), fluoropolymer, or modified fluoropolymer (XF) on its surface may be used as a suitable material for the first filler 21 and the second filler 22, which satisfies such characteristics.

In this case, the material of the first filler 21 is the same as the material of the second filler 22 in order to suppress the manufacturing cost. However, the present invention is not limited thereto. The material of the first filler 21 may be different from the material of the second filler 22. In this case, a tensile strength of the first filler 21 is preferably not less than a tensile strength of the second filler 22 since the load applied to the first filler 21 arranged at the cable center increases when the cable 1 is bent.

In the present embodiment, each of the first filler 21 and the second filler 22 has a circular cross-section (a circular shape when the load is not applied thereto). However, the present invention is not limited thereto. For example, each of the first filler 21 and the second filler 22 may have an elliptical shape or a polygonal shape. However, it is more preferable that the first filler 21 and the second filler 22 have circular cross-sections from the viewpoint of providing an entire cable 1 with a good balance in accordance with the outer shape of the twisted pair wires 30, and moving the first filler 21 and the second fillers 22 easily in the cable longitudinal direction in bending the cable 1 by suppressing a contact area between the twisted pair wire 30 and the fillers 21, 22 or a contact area between the first filler 21 and the second fillers 22.

(Cable Core 5)

The cable core 5 is formed by spirally twisting four twisted pair wires 30 and four second fillers 22 around the first filler 21. At this time, the twisted pair wires 30 and the second fillers 22 are alternately arranged in the circumferential direction. The twisting direction of the cable core 5 is opposite to the twisting direction of the twisted pair wire 30. That is, the twisting direction of the cable core 5 is the same as the twisting direction of the conductor 311. The twisting direction of the cable core 5 is a rotational direction of the twisted pair wires 30 and the second fillers 22 from the other end to one end of the cable core 5 when being viewed from the one end of the cable core 5.

In the present embodiment, the twisted pair wire 30 directly contacts an outer surface of the first filler 21 and an inner surface of the binder tape 6 since the outer diameter of the second filler 22 is smaller than the outer diameter of the twisted pair wire 30. The second filler 22 is provided to fill a space between the twisted pair wires 30, 30 adjacent to each other in the circumferential direction and the inner surface of the binder tape 6. The second filler 22 directly contacts the twisted pair wires 30, 30 adjacent to each other in the circumferential direction and the inner surface of the binder tape 6, while the second filler 22 does not contact the first filler 21.

(Binder Tape 6)

The binder tape 6 is spirally wrapped around the cable core 5. The binder tape 6 serves to suppress the twist of the cable core 5 from loosening and separate the cable core 5 from the shield layer 7. The binder tape 6 is spirally wrapped around the cable core 5 in such a manner that side edges in its width direction will partially overlap. As the binder tape 6, it is preferable to use a material with a rigidity and a restoring force (elastic force) to return in a linear shape as low as possible, in order to suppress the binder tape 6 from damaging the shield layer 7 when the cable 1 is repeatedly bent. For example, a paper tape or a non-woven fabric tape may be used as the binder tape 6.

(Shield Layer 7)

The shield layer 7 is composed of a braided shield formed by braiding a plurality of metal wires (metal strands). The shield layer 7 is provided to cover around the binder tape 6. In the present embodiment, the shield layer 7 has a double-layer structure composed of a first shield layer 71 provided to cover around the binder tape 6, and a second shield layer 72 provided to cover around the first shield layer 71. However, the shield layer 7 may be composed of a single layer.

A metal wire (metal strand) having a small outer diameter of less than 0.10 mm is preferably used for the first and second shield layers 71, 72 in order to reduce the diameter of the cable 1 and improve flexibility. In the present embodiment, a metal wire composed of an annealed copper wire with an outer diameter of 0.08 mm is used. Each of the first and second shield layers 71, 72 may be a lateral winding shielding layer formed by spirally winding a plurality of metal braids side by side. As the metal wire constituting each of the first and second shield layers 71, 72, e.g., an elementary wire composed of copper, aluminum, or alloy of such metals, or an elementary wire composed of a fiber thread and a metal layer composed of a metal foil or a metallic plating on an outer surface of the fiber thread may be used.

(Sheath 8)

The sheath 8 is provided to cover around the shield layer 7 (the second shield layer 72). In the present embodiment, a sheath composed of polyvinylchloride resin is used as the sheath 8. However, the material of the sheath 8 is not limited thereto. For example, the material of the sheath 8 may be composed of a resin component comprising at least one resin of urethane resin, fluoropolymer, fluoro-rubber as a main component (a base resin). The thickness of the sheath 8 is 0.6 mm or more and 1.0 mm or less. The outer diameter of the cable 1 is 6.0 mm or more and 9.0 mm or less. In the present embodiment, the thickness of the sheath 8 is 0.8 mm and the outer diameter of the cable 1 is 7.2 mm.

(Evaluation of Transmission Characteristics)

A sample of the cable 1 shown in FIG. 1 was prepared, and the pair-to-pair crosstalk (far-end crosstalk) and attenuation amount were measured. The pair-to-pair crosstalk and the attenuation amount were measured by using a network analyzer under the condition of a cable length of 8 m at a temperature of 20° C. for a frequency of 1.0 MHz to 500.0 MHz. The measurement results of the pair-to-pair crosstalk and the standard value according to category 6A are summarized in Table 1. The measurement results of the attenuation amount and the standard value according to category 6A are summarized in Table 2. In Tables 1 and 2, four twisted pair wires 30 are respectively shown as A to D. For example, in Table 1, a column in which a first row is A and a second row is B for item "pair-to-pair crosstalk" represents the pair-to-pair crosstalk between the twisted pair wire A and the twisted pair wire B.

TABLE 1

| | Category 6A | Pair-to-pair crosstalk (dB) | | | | | |
|---|---|---|---|---|---|---|---|
| Frequency (MHz) | Standard Value (dB) | A B | A C | A D | B C | B D | C D |
| 1.0 | 67.8 | 108.1 | 91.9 | 95.1 | 92.0 | 91.4 | 96.5 |
| 10.0 | 47.8 | 88.6 | 88.8 | 101.3 | 92.6 | 87.5 | 98.0 |
| 25.0 | 39.8 | 92.0 | 88.0 | 88.9 | 89.4 | 91.2 | 91.7 |
| 62.5 | 31.9 | 96.2 | 97.8 | 98.5 | 92.6 | 95.5 | 94.8 |
| 100.7 | 27.8 | 108.3 | 92.6 | 95.3 | 101.6 | 90.3 | 95.6 |
| 251.3 | 19.8 | 99.1 | 86.3 | 91.5 | 87.2 | 94.0 | 94.1 |
| 300.3 | 18.3 | 90.6 | 95.3 | 94.1 | 100.7 | 94.1 | 89.9 |
| 401.9 | 15.8 | 103.3 | 96.7 | 90.4 | 95.3 | 91.8 | 85.6 |
| 500.0 | 13.8 | 92.1 | 94.4 | 95.3 | 100.1 | 84.8 | 82.8 |

TABLE 2

| Frequency | Category 6A | Attenuation (dB) | | | |
|---|---|---|---|---|---|
| (MHz) | Standard Value (dB) | A | B | C | D |
| 1.0 | 2.1 | 0.25 | 0.24 | 0.23 | 0.24 |
| 10.0 | 5.9 | 1.14 | 1.19 | 1.13 | 1.27 |
| 25.0 | 9.4 | 2.03 | 2.16 | 2.02 | 2.30 |
| 62.5 | 15.0 | 3.44 | 3.67 | 3.41 | 3.92 |
| 100.7 | 19.1 | 4.54 | 4.84 | 4.49 | 5.18 |
| 251.3 | 31.1 | 8.17 | 7.89 | 7.89 | 8.58 |
| 300.3 | 34.3 | 7.73 | 7.88 | 7.82 | 8.29 |
| 401.9 | 40.1 | 7.51 | 7.31 | 8.52 | 7.79 |
| 500.0 | 45.3 | 8.63 | 7.56 | 8.97 | 8.08 |

As shown in Tables 1 and 2, the cable 1 according to the present embodiment satisfies the standard values according to the category 6A for the pair-to-pair crosstalk and the attenuation amount at a frequency of 1.0 to 500.0 MHz. Thus, it is confirmed that the cable 1 has good transmission characteristics.

(Evaluation of Flex Resistance)

Figure 4:
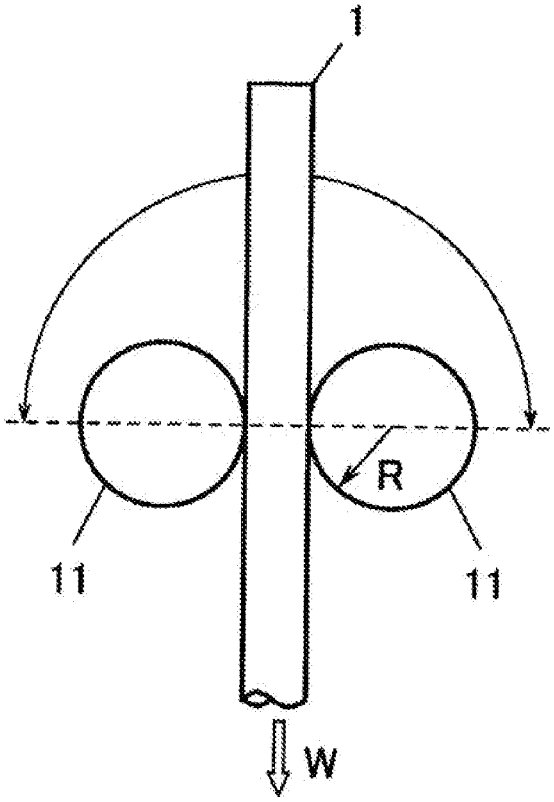
FIG. 4 is an explanatory view showing a flex resistance test.

Three samples of the cable 1 shown in FIG. 1 were prepared. The flex resistance was evaluated by conducting ±90° bending test for each of the three samples of the cable 1. The ±90° bending test was conducted as follows. As shown in FIG. 4, a weight of a load W=2N (0.2 kgf) was hung at a lower end of a test sample of the cable 1, and curved bending jigs 11, 11 were attached to a left side and a right side of the test sample of the cable 1. In this state, the test sample of the cable 1 was bent by applying a bending force with a bending angle at ±90° toward left and right directions along the bending jigs 11, 11. A bending R (bending radius) was approximately 2 times the outer diameter of the cable 1 (i.e., approximately 7.2 mm). A bending speed was 30 times/min, and a bending frequency was counted by one reciprocation from side to side as 1 time. Then, the test sample of the cable 1 was repeatedly bent, and the electric continuity of the conductor 311 between both ends of the test sample of the cable 1 was examined at every appropriate times. When the resistance value is increased by 20% of a resistance value before the test (initial resistance), such an increase is regarded as an occurrence of disconnection (breakage) in the conductor 311, and a bending frequency at the time of disconnection is defined as bending life.

According to the result of the ±90° bending test for each of the three samples of the cable 1 under a severe condition where the bending R (bending radius) was approximately 2 times the outer diameter of the cable 1, the increment of the resistance at 1 million times bending frequency was 0.1% to 0.4%. Namely, in the cable 1 according to the present embodiment, the resistance of the conductor 311 hardly increases (the increment of the resistance is not more than 5%) at 1 million times bending frequency, and the cable 1 did not end the bending life.

(Variations)

Figure 2:
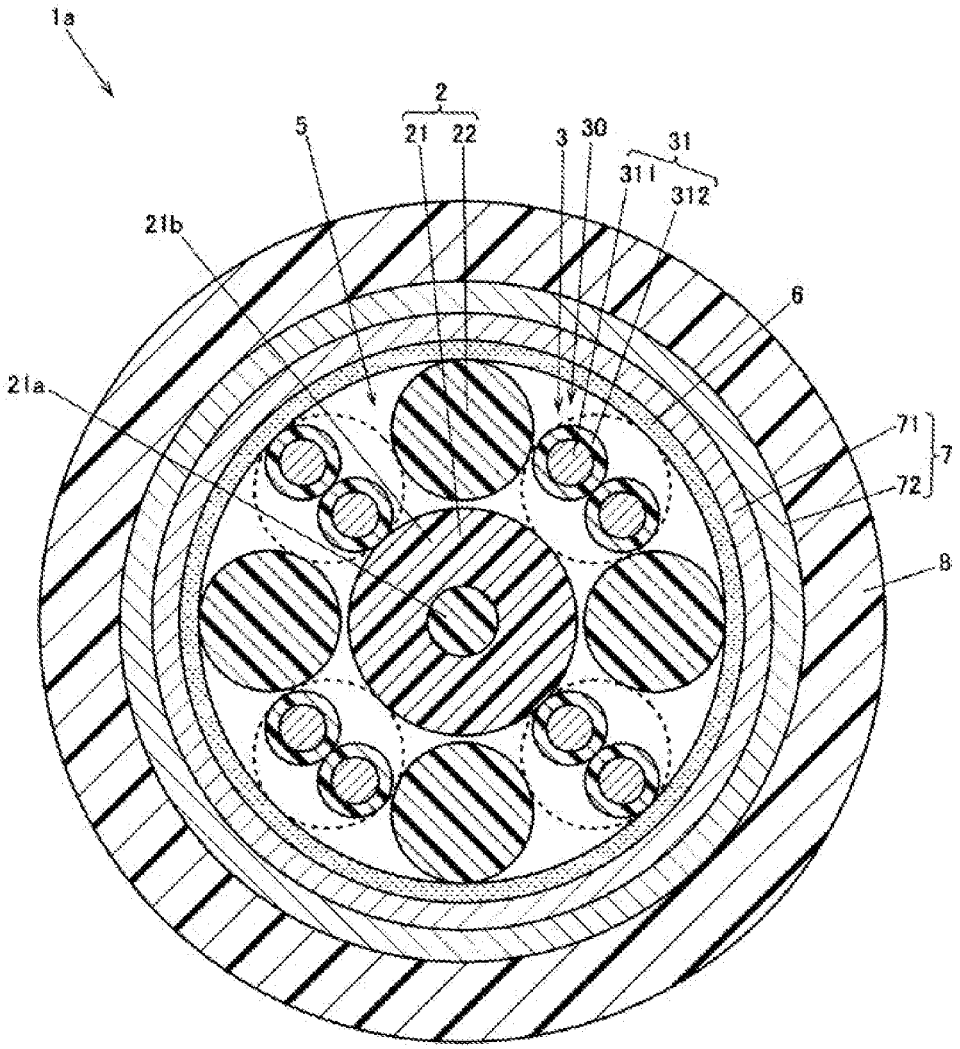
FIG. 2 is a cross-sectional view showing a cross-section perpendicular to a cable longitudinal direction of a cable according to a variation of the present invention.

As to the present embodiment, the cable 1 comprising the first filler 21 made of a single material is explained. However, the present invention is not limited thereto. The first filler 21 may be composed of a combination of two or more materials. For example, in a cable 1*a* as shown in FIG. 2, the first filler 21 may include a tension member 21*a* and an insulation layer 21*b* covering around the tension member 21*a*. For example, a stranded steel wire, a high-tension fiber, or the like may be used as the tension member 21*a*. When the first filler 21 includes the tension member 21*a*, the tension member 21*a* can receive a tensile force in bending, thereby achieve the high flex resistance that can suppress the disconnection when the cable is used for an application subjected to repetitive hard bending or overhead wiring.

Figure 3:
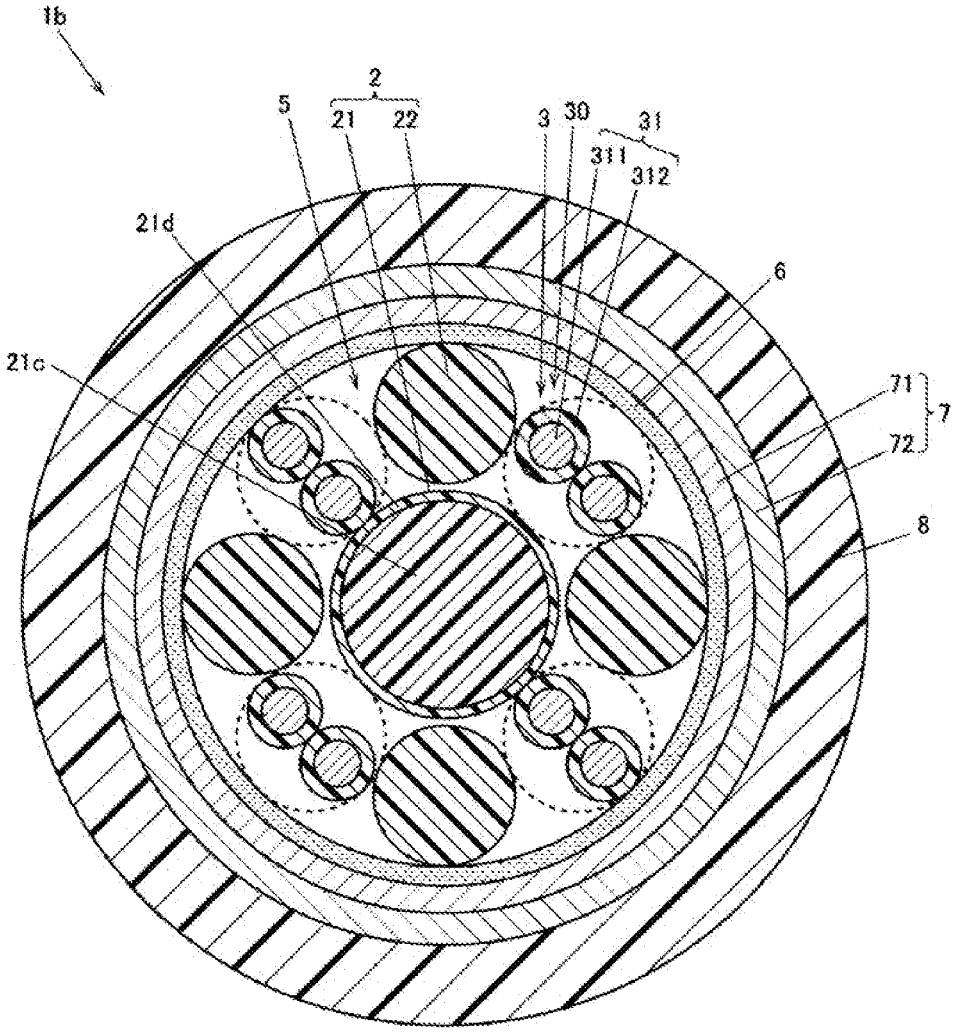
FIG. 3 is a cross-sectional view showing a cross-section perpendicular to a cable longitudinal direction of a cable according to another variation of the present invention.

Further, in a cable 1*b* as shown in FIG. 3, the first filler 21 may be formed by spirally wrapping a resin tape 21*d* around an insulation layer 21*c* having a circular cross-section. For example, polytetrafluoroethylene (PTFE) has a good slidability on a surface but is an expensive material. For example, according to a configuration in which the insulation layer 21*c* is made of an inexpensive resin such as polyethylene (PE) and a resin tape 21*d* made of a material having good slidability such as PTFE around the insulation layer 21*c*, it is possible to achieve the first filler 21 that can decrease manufacturing cost and has good slidability. Therefore, it is possible to achieve the cable 1*b* which can decrease the manufacturing cost and has good flex resistance.

Effects of Embodiment

As described above, the cable 1 according to the present embodiment comprises the linear first filler 21 provided at the center of the cable, a plurality of twisted pair wires 30 formed by twisting a pair of insulated wires 31, a plurality of linear second fillers 22 having the same number as the number of the twisted pair wires 30, the shield layer 7 provided to cover around the cable core 5 which is formed by spirally twisting the plurality of twisted pair wires 30 and the plurality of second fillers 22 around the first filler 21 in such a manner that the twisted pair wire 30 and the second filler 22 are alternately arranged in a circumferential direction, and the sheath 8 covering around the shield layer 7.

By separating the adjacent twisted pair wires 30, 30 from each other in the circumferential direction with the second filler 22, it is possible to increase a pair-to-pair distance, thereby suppress the pair-to-pair crosstalk. Thus, it is possible to achieve good transmission characteristics satisfying the standard values according to the category 6A. In addition, it is possible to move the second fillers 22 with respect to the first filler 21 in the cable longitudinal direction by separately forming the first filler 21 and the second fillers 22. The first filler 21 and the second fillers 22 are hard to be broken even when the cable 1 is repeatedly bent.

Further, by setting the outer diameter of the second filler 22 to be 0.8 times or more and 1.0 times or the outer diameter of the twisted pair wire 30, it is possible to ensure the pair-to-pair distance, thereby suppress the pair-to-pair crosstalk, and to keep constant positions of the twisted pair wires 30 (a positional relationship between the twisted pair wires 30, 30) when the cable is bent. In addition, it is possible to achieve the cable 1 having high flex resistance to resist against the repetitive bending for millions to tens of million times, and good transmission characteristics which can sufficiently satisfy the standard values according to the category 6A.

SUMMARY OF THE EMBODIMENT

Next, the technical concept grasped from the above-described embodiment is described with reference to the signs or the like in the embodiment. However, each sign or the like in the following description is not limited to a member or the like specifically showing the elements in the following claims in the embodiment.

[1] A cable (1), comprising:

a cable core (5) comprising a linear filler (2), and a plurality of core wires (3) for signal transmission;

a shield layer (7) covering around the cable core (5); and a sheath (8) covering around the shield layer (7), wherein the filler (2) comprises a first filler (21) provided at a cable center, and a plurality of second fillers (22) provided around the first filler (21) to form a cross-shape with the first filler (21) in a cross-section perpendicular to a cable longitudinal direction, wherein the cable core (5) is configured in such a manner that the plurality of core wires (3) and the plurality of second fillers (22) are spirally twisted around the first filler (21) to be alternately arranged in a circumferential direction.

[2] The cable (1) according to [1], wherein the plurality of second fillers (22) are provided to be attachable to and detachable from the first filler (21) when the cable core (5) is bent.

[3] The cable (1) according to [1] or [2], wherein an outer diameter of the first filler (21) is greater than an outer diameter of the second filler (22).

[4] The cable (1) according to any one of [1] to [3], wherein an outer diameter of the second filler (22) is 0.8 times or more and 1.0 times or less an outer diameter of the core wire (3).

[5] The cable (1) according to any one of [1] to [4], wherein a tensile strength of the first filler (21) is higher than a tensile strength of the second filler (22).

[6] The cable (1) according to any one of [1] to [4], wherein the core wire (3) comprises a twisted pair wire (30).

Although the embodiments of the invention have been described, the invention according to claims is not to be limited to the embodiments. In addition, please note that all combinations of the features described in the embodiments are not necessary to solve the problem of the invention. Furthermore, the various kinds of modifications can be implemented without departing from the gist of the invention.

What is claimed is:

1. A cable, comprising:

a cable core comprising a linear filler, and a plurality of core wires for signal transmission;

a shield layer covering around the cable core; and a sheath covering around the shield layer, wherein the filler comprises a first filler provided at a cable center, and a plurality of second fillers provided around the first filler to form a cross-shape with the first filler in a cross-section perpendicular to a cable longitudinal direction, wherein the cable core is configured in such a manner that the plurality of core wires and the plurality of second fillers are spirally twisted around the first filler to be alternately arranged in a circumferential direction, wherein an outer diameter of the first filler is greater than an outer diameter of a second filler of the plurality of second fillers, wherein the second fillers are arranged at a position for distancing the core wires, which are adjacent to each other in a circumferential direction, from each other, while the second fillers are brought contact with the adjacent core wires, respectively, and wherein the core wires and the second fillers are alternately arranged in the circumferential direction so that the first filler and the second fillers are integrated to provide an approximately cross-shaped filler as a whole.

2. The cable according to claim 1, wherein the plurality of second fillers is provided to be attachable to and detachable from the first filler when the cable core is bent.

3. The cable according to claim 1, wherein an outer diameter of the second filler of the plurality of second fillers is 0.8 times or more and 1.0 times or less an outer diameter of the core wire.

4. The cable according to claim 1, wherein a tensile strength of the first filler is higher than a tensile strength of the second filler of the plurality of second fillers.

5. The cable according to claim 1, wherein the core wire comprise a twisted pair wire.

6. The cable according to claim 1, wherein a first core wire of the plurality of cores wires is offset 90 degrees from another of the plurality of core wires, and wherein a first second filler of the plurality of second fillers is offset 90 degrees from another of the plurality of second fillers.

7. The cable according to claim 1, wherein, with respect to a center of the first filler, a first core wire of the plurality of core wires is offset 45 degrees from a first second filler of the plurality of second fillers.

8. The cable according to claim 1, wherein an outer diameter of the first filler is 1.5 to 1.7 times an outer diameter of the second filler of the plurality of second fillers.

9. The cable according to claim 1, an outer diameter of the second filler of the plurality of second fillers is approximately the same as an outer diameter of the core wires.

10. The cable according to claim 1, wherein a size of the second filler of the plurality of second fillers is set based on suppressing pair-to-pair crosstalk of the core wires.

* * * * *